United States Patent [19]

Linstromberg

[11] 4,095,439

[45] Jun. 20, 1978

[54] MOVABLE ICE RECEPTACLE

[75] Inventor: William John Linstromberg, Evansville, Ind.

[73] Assignee: Whirlpool Corporation, Benton Harbor, Mich.

[21] Appl. No.: 749,536

[22] Filed: Dec. 10, 1976

[51] Int. Cl.[2] ..... F25C 5/18

[52] U.S. Cl. ..... 62/344; 312/274

[58] Field of Search ..... 62/137, 344; 312/311, 312/274, 271

[56] References Cited

U.S. PATENT DOCUMENTS

| | | | |
|---|---|---|---|
| 659,105 | 10/1900 | Sander | 312/274 |
| 924,027 | 6/1909 | Wolf | 312/274 |
| 3,280,578 | 10/1966 | Linstromberg | 62/344 X |
| 3,883,204 | 5/1975 | Prada et al. | 62/344 X |

*Primary Examiner*—William E. Wayner

*Attorney, Agent, or Firm*—Wegner, Stellman, McCord, Wiles & Wood

[57] ABSTRACT

A movable ice receptacle for use in a refrigeration apparatus having a refrigerated cabinet defining a space within which the receptacle is normally disposed. The refrigerated space is selectively closed by a movable closure. The receptacle is mounted for selective disposition in a rearward ice storage position and a forward ice access position. The mounting of the receptacle is such that, when the closure is moved to an open position, the receptacle is correspondingly repositioned forwardly from the storage position to the access position. For improved dispensing of the ice in the receptacle, a rapid deceleration is effected at the forward end of the receptacle movement effectively shifting the ice in the receptacle to a forward, more readily accessible portion thereof. The receptacle may be gravity biased toward the forward ice access position and urged against the bias thereof by structure associated both the the closure and the receptacle to move the receptable to the rearward storage position as an incident of the closure being disposed in the space-closing position. The mounting structure may be arranged to swingably mount the receptacle for movement in an arc. The storage position may be at a level above the level of the access position. The swinging movement may have a maximum speed when the receptacle is at the access position. At the access position, the receptacle movement may be substantially horizontal. A sensing element may be extended downwardly into the receptacle to sense the level of ice therein when the receptacle is in the ice storage position. The movement of the receptacle from the ice storage position to the access position may be downwardly to preclude interference between the sensing element and the receptacle during such repositioning.

21 Claims, 10 Drawing Figures

MOVABLE ICE RECEPTACLE

BACKGROUND OF THE INVENTION

1. Field of the Invention

This invention relates to refrigeration apparatus and in particular to means for providing controlled access to collected ice bodies in a refrigerated space defined by the apparatus cabinet.

2. Description of the Prior Art

In U.S. Pat. No. 3,602,007 of Philip J. Drieci, an ice storage receptacle is mounted on a small access door carried by a main freezer door of the refrigerator.

In U.S. Pat. No. 3,744,270 of Charles A. Wilcox, the ice receptacle comprises a drawer which includes a front piece effectively forming an additional door to the freezer compartment.

In Donald E. Hilliker et. al. U.S. Pat. No. 3,643,464, a small secondary door is provided for closing an opening in the main freezer door. As in the Wilcox patent, the secondary door is selectively connected to the ice receptacle so as to cause the receptacle to move forwardly to an accessible position when the small door is moved to an open position. The connection between the small door and the ice receptacle is broken when the main freezer door is opened. In the access position, the ice receptacle is spaced inwardly of the opening in the main freezer door, thereby limiting access to the receptacle. The receptacle is limited in its forward movement by suitable stops to permit the small access door to be swung away from the receptacle breaking the connection therebetween while yet maintaining the receptacle in the preselected position so that upon return of the small access door, the connection is remade for subsequent control of the movement of the receptacle within the cabinet.

In U.S. Pat. No. 3,883,204 of Luis E. Prada et. al., an ice access apparatus of the type disclosed in the Hilliker patent is provided with an improved means for selectively coupling an ice receptacle to an ice access door.

A number of different prior art structures utilizing movable shelves have been developed. Illustratively, Carl Sander, in U.S. Pat. Ser. No. 659,105 shows a refrigerator having means for automatically moving a sliding support through the action of opening or closing the door to a compartment.

William Robert Wolf shows, in U.S. Pat. Ser. No. 924,027, a cabinet having a plurality of shelves suspended on pivotal links with the assembly being swung by the action of the opening and closing of a front door of the cabinet through an interconnecting lever on the door.

Carl H. Hoffstetter et. al., in U.S. Pat. No. 1,922,585, show a broiler oven wherein the broiler pan is moved inwardly or outwardly through the broiler oven door opening so as to provide access to the contents of the pan for inspection or other purposes. The broiler pan is carried on swingable arms with the swinging of the structure controlled by a handle at the side of the oven cabinet after the door is opened.

In U.S. Pat. No. 2,375,359 of William T. Hedlund, a spring-biased tray is supported beneath the evaporator. The swinging movement is controlled by a manually operable handle.

Charles L. Liggett, in U.S. Pat. No. 2,667,396, shows a table, or the like, with a normally concealed minor service member which is swingably mounted by suitable struts which, when released, permit the service member to swing downwardly to a hanging access position.

George C. Harbison, in U.S. Pat. No. 2,776,866, shows a receptacle mounted to the inside of the refrigerated door on swingable links.

James W. Jacobs, in U.S. Pat. No. 3,814,492, and Frank Schneller, in U.S. Pat. No. 3,857,623, disclose additional movable shelf structures wherein the shelves are mounted to swingable links.

SUMMARY OF THE INVENTION

The present invention comprehends an improved means for providing access to an ice receptacle in a refrigeration apparatus wherein the ice receptacle is automatically moved to an access position as an incident of removing a closure from a position wherein it closes an opening to the refrigeration space in which the ice receptacle is disposed.

In the illustrated embodiment, the receptacle is carried on mounting means which permits the receptacle to be disposed in an ice access position at the opening when the closure is moved from the closed position across the opening. The receptacle may be gravity biased toward the ice access position and urged to a rearward ice storage position as an incident of the closure being moved to the position wherein it closes the opening to the refrigeration space.

The invention comprehends the provision of means for effecting rapid deceleration of the forward movement of the receptacle in moving to the access position so as to tend to urge the ice bodies therein toward a forward portion of the receptacle for facilitated access.

In the illustrated embodiment, the receptacle is swingably carried by the mounting means to swing in an arc downwardly from the rearward ice storage position. The mounting means may be arranged to cause the receptacle to be moving substantially horizontally at the access position.

The receptacle may be disposed subjacent an ice maker having a sensing element extending downwardly into the receptacle to sense the level of ice bodies collected therein in the storage position. The downward movement of the receptacle in swinging to the access position is preselected to lower the receptacle relative to the sensing element, thereby preventing interference therebetween in the movement of the receptacle to the access position.

In the illustrated embodiment, the closure comprises a small door carried in the main freezer door of the refrigeration apparatus. The mounting means may comprise a plurality of arms arranged to carry the receptacle to extend generally horizontally in each of its different positions. The receptacle may be removably carried by the mounting means for further facilitated dispensing of the collected ice bodies therefrom. As the movement of the receptacle is preferably gradually downwardly at the initiation of the movement from the storage position, the collected ice bodies are not urged rearwardly during this portion of the movement, thereby further assuring the disposition of the ice bodies in the forward, more readily accessible portion of the receptacle when the receptacle is stopped in the access position. As the receptacle is moving at maximum speed at this point in its travel, the maximum forward shifting of the ice bodies is effected in the disclosed arrangement.

The apparatus of the present invention is extremely simple and economical of construction while yet providing the highly desirable features discussed above.

BRIEF DESCRIPTION OF THE DRAWING

Other features and advantages of the invention will be apparent from the accompanying description taken in connection with the accompanying drawing wherein.

DESCRIPTION OF THE PREFERRED EMBODIMENTS

Figure 1:
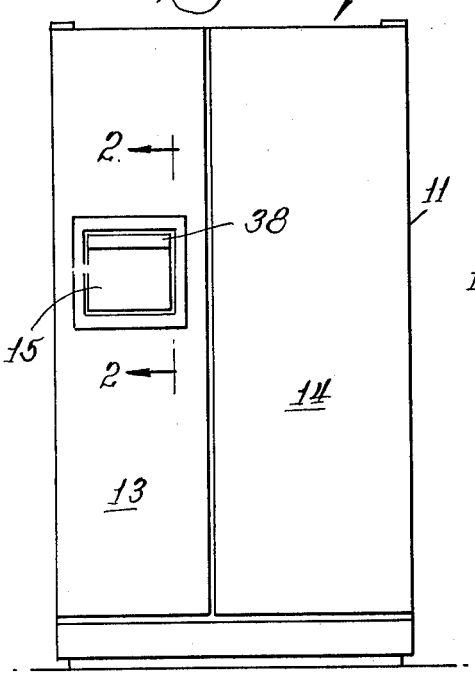
FIG. 1 is a front elevation of a refrigeration apparatus having improved means embodying the invention for providing access to collected ice bodies therein.

In the exemplary embodiment of the invention as disclosed in FIGS. 1-8 of the drawing, a refrigeration apparatus generally designated 10 is shown to comprise a side-by-side freezer-refrigerator. The cabinet 11 defines a freezer space 12, which is selectively closed by a front door 13. A similar door 14 is provided for selectively closing the refrigerator portion of the apparatus. Freezer door 13 may be provided with a small door, or closure, 15 for selectively closing an opening 16 in the main freezer door for providing controlled access to collected ice bodies 17 within a collecting receptacle 18 in freezer space 12.

In the illustrated embodiment, ice bodies are formed in an automatic ice maker generally designated 19 which may be of conventional construction and provided with a sensing element 20 arranged to extend downwardly into the receptacle 18 to sense the level of ice bodies 17 therein for automatically controlling the operation of the ice maker. The receptacle is carried by mounting means generally designated 21 including a pair of front links 22 and rear links 23 and a lower support 24. The receptacle may be removably installed on the support for removal from the apparatus for facilitated dispensing of the ice bodies, when desired, as shown in broken lines in FIG. 3.

Each of the mounting links may be pivotally connected to the cabinet 11 by suitable pivots 25 at their upper ends, and to the support 24 by pivots 26 at their lower ends. Extending transversely between the rear links 23 is a crossbar 27 which is adapted to engage the sensing element 20 when the rear links 23 are moved forwardly from the position of FIG. 2 to the position of FIG. 3 to raise the sensing element sufficiently to prevent further operation of the ice maker 19.

Figure 2:
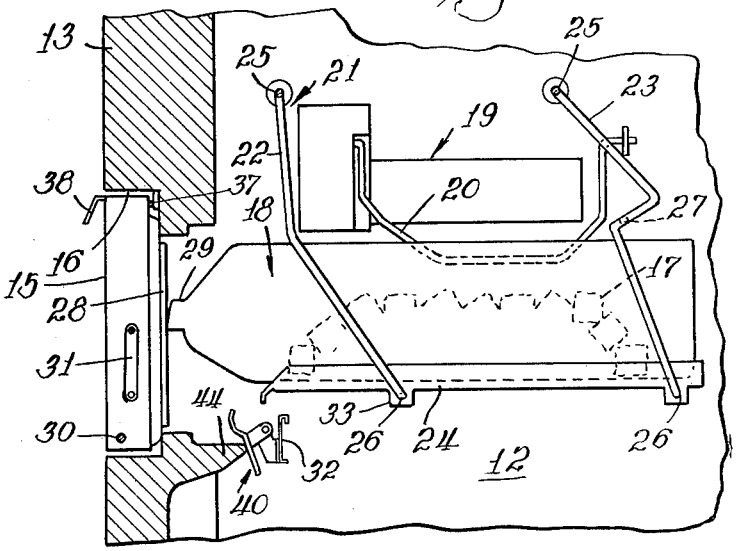
FIG. 2 is a fragmentary enlarged vertical section taken substantially along the line 2—2 of FIG. 1.

As illustrated in FIG. 2, closure 15 includes an inner surface portion 28 adapted to engage a front handle portion 29 on receptacle 18 when the closure is moved to the position of FIG. 2 closing opening 16. In the illustrated embodiment, the closure 15 is pivotally mounted to the freezer door 13 by suitable pivots 30 so as to swing about a horizontal axis from the upright, closed position of FIG. 2, to a horizontal, open position of FIG. 3. Pivoted arms 31 may be connected between the door 13 and closure 15 to limit the forward pivoting of the closure to the horizontal position of FIG. 3.

Figure 3:
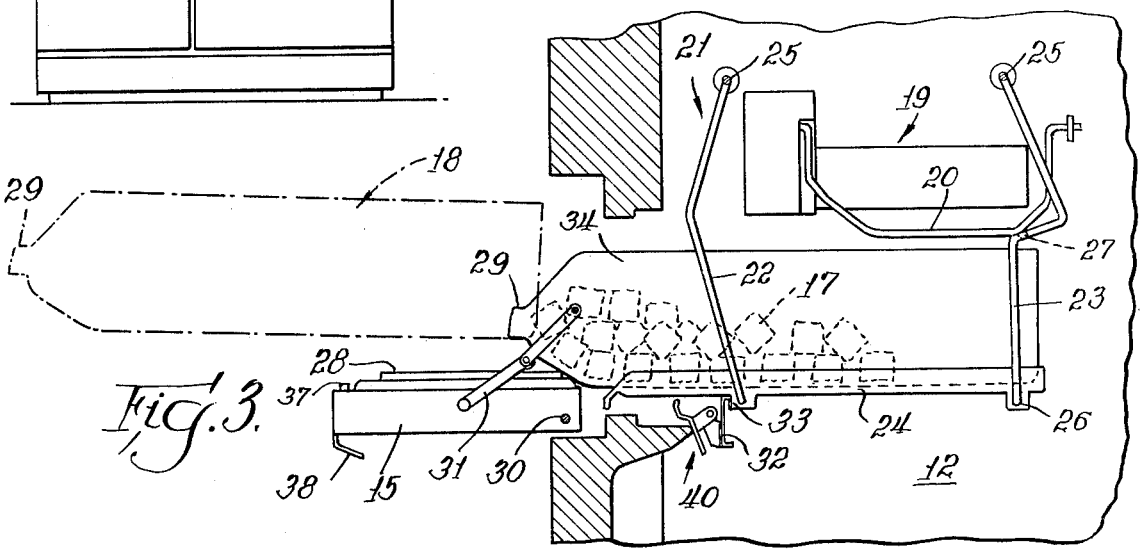
FIG. 3 is a fragmentary vertical section similar to that of FIG. 2 but with the apparatus arranged to provide access to the collected ice bodies in the receptacle, the receptacle being shown in broken lines as removed from the mounting means for further facilitated dispensing of the collected ice bodies therefrom.
Figure 4:
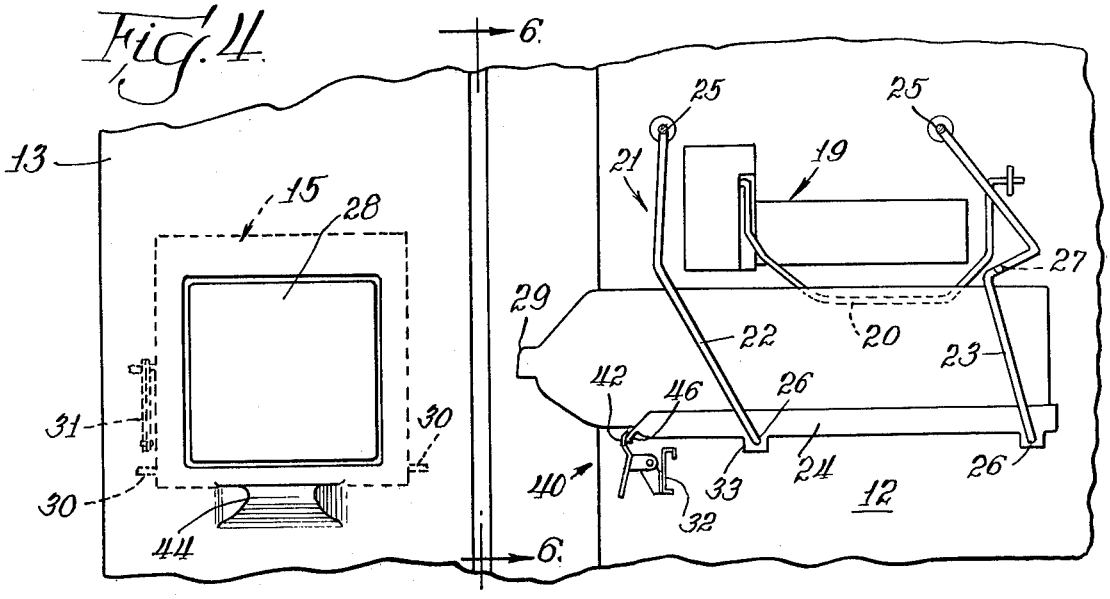
FIG. 4 is a fragmentary vertical section illustrating the arrangement of the apparatus with the main freezer door opened.

When closure 15 is moved from the closed position of FIG. 2, the receptacle 18 swings downwardly on support links 22 and 23 from the storage position of FIG. 2. The arrangement of the mounting means is such that the receptacle is in an uppermost rearward position in the storage position of FIG. 2 and swings downwardly through an arc having a radius defined by the length of links 22 and 23 to a lowermost position, as seen in FIG. 3. At this point in the travel of the receptacle, the receptacle is moving with maximum forward velocity.

A stop bar 32 is mounted to the cabinet 11 to extend across the freezer space 12 inwardly of door opening 16. Receptacle support 24 is provided with a depending shoulder portion 33 carrying pivots 26 and positioned so as to engage stop bar 32 when the receptacle reaches the access position of FIGS. 3 and 5.

The sudden rapid deceleration of the receptacle by the abutment of stop shoulder 33 with stop bar 32 at the time of maximum forward travel speed of the receptacle permits the inertial force of the collected ice bodies 17 therein to urge them toward the front portion 34 of the receptacle. Thus, as shown in FIG. 3, the collected ice bodies 17 are resultingly disposed within the forward receptacle portion 34 for facilitated access by the user through an upwardly opening recess 35 in the front wall 36 of the receptacle portion 34.

As the initial arcuate movement of the receptacle starting from the storage position of FIG. 1 includes a substantial downward component, rearward movement of the collected ice bodies during the initial movement is effectively minimized. The inertial movement of the ice bodies due to the rapid deceleration at the access position effectively maximizes the disposition of the collected ice bodies in the readily accessible front portion of the receptacle, as discussed above.

Conversely, as the receptacle 18 is returned to its storage position, its initial movement is essentially totally horizontal, causing a further shift of the collected ice bodies 17 toward the front receptacle portion 34. Yet, when the receptacle reaches the storage position the horizontal component of motion is substantially reduced, thus minimizing any undesirable rearward shift of the ice bodies.

The relative proportion of vertical versus horizontal movement which the receptacle 18 experiences is a function of the length of the links 22 and 24, the location of the pivot points 25 and the length of the arc through which the receptacle is permitted to swing. By way of example, a vertical movement of one inch with an accompanying horizontal movement of four inches has been found to provide satisfactory ice access as well as the desired ice shifting function described above.

To ensure that the receptacle 18 remains stationary while in its access position, it is desirable that stop shoulder 33 engage stop bar 32 just before the support 24 reaches what would otherwise be its lowermost position. This biases the stop shoulder into positive engagement with the stop bar, thus minimizing free swinging movement of the support 24 and receptacle 18 as the user withdraws ice bodies.

Figure 5:
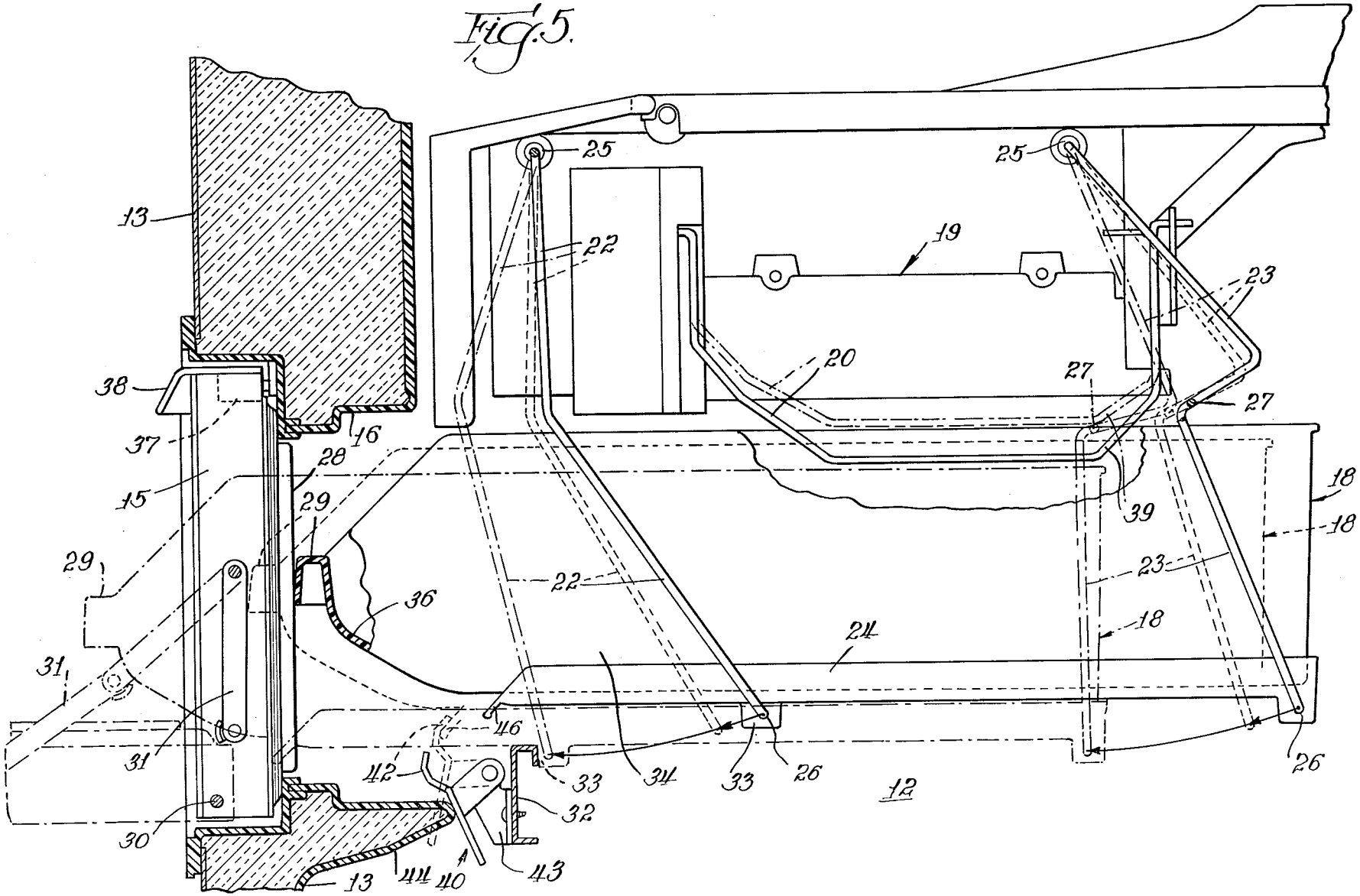
FIG. 5 is a fragmentary enlarged vertical section showing in greater detail the mounting of the receptacle in a number of different dispositions thereof.
Figure 6:
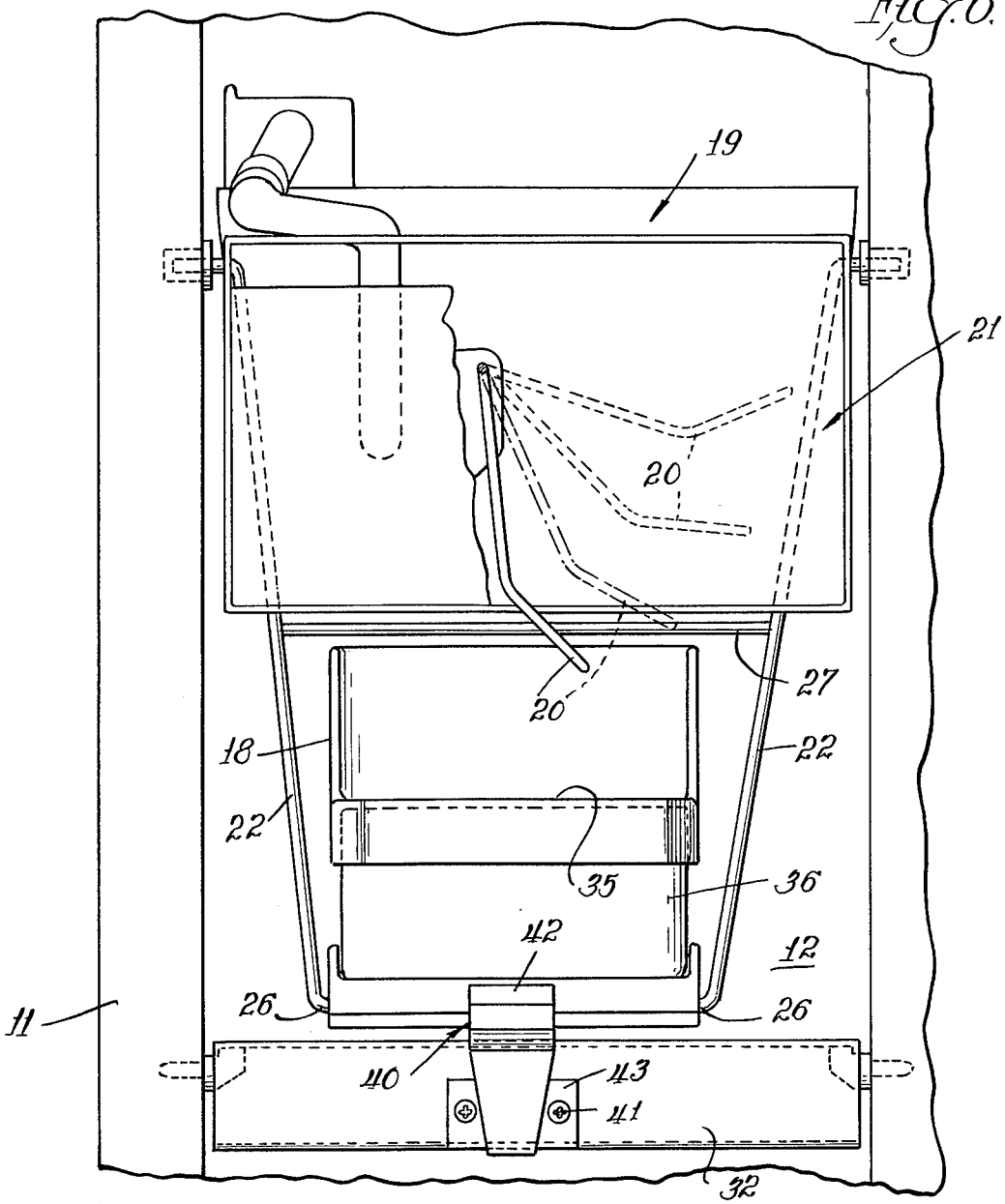
FIG. 6 is a fragmentary front elevation of the apparatus with the freezer door open, as shown in FIG. 4.

As shown in FIG. 5, closure 15 may be provided with a conventional magnetic latch 37 for maintaining the closure in the upright, closed position. The closure may further be provided with a handle 38 for manually swinging the closure between the closed and open positions of FIGS. 2 and 3.

As illustrated in FIG. 5, the sensing element 20 includes an angled rear portion 39 adapted to be engaged by the crossbar 27 so as to permit a progressive camming action of the sensing element by the swinging of the receptacle. As shown in FIG. 5, when the receptacle is in the rearward ice storage position shown in full lines therein, the sensing element extends downwardly into the receptacle with the cross-bar 27 spaced rearwardly of the sensing element portion 39, permitting the sensing element to function in the normal manner in sensing the level of ice bodies in the receptacle for automatically controlling the making of ice bodies by the ice maker 19. As ice access closure door 15 moves to the open position, the receptacle moves forwardly to the ice access position shown in broken lines in FIG. 5 causing the crossbar 27 to move along camming portion 39 of the sensing element and thereby raise the sensing element to the "Off" position shown in broken lines in FIG. 5. Concurrently, the swinging of the receptacle downwardly and forwardly from the storage position causes the top of the receptacle to move to below the "On" position of the sensing element shown in full lines in FIG. 5.

Figure 7:
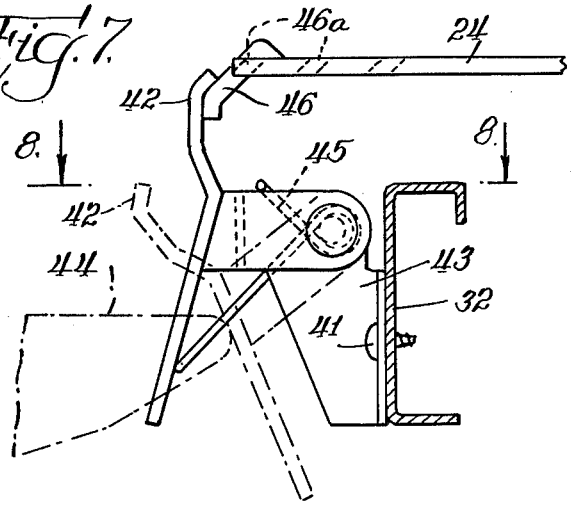
FIG. 7 is a fragmentary enlarged side elevation of the stop means for retaining the receptacle in an intermediate position upon opening of the freezer door.
Figure 8:
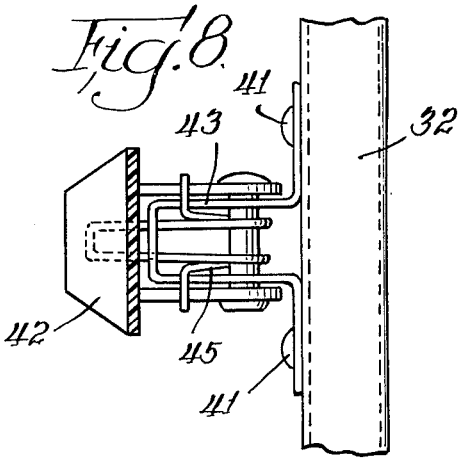
FIG. 8 is a horizontal section taken substantially along the line 8—8 of FIG. 7.

When it is desired to provide access to the entire freezer space 12 rather than merely to the ice receptacle, freezer door 13 may be opened. At such time, it may be desirable to prevent the movement of the receptacle to the projecting ice access position, and for this purpose, a selectively positionable stop 40 is mounted to the stop bar 32 as by suitable screws 41. The stop includes a shoulder element 42 pivotally mounted to a support 43. Freezer door 13 includes a rearwardly projecting shoulder portion 44 which engages the shoulder element 42 when the freezer door is in the closed position of FIG. 5 to pivot the shoulder element in a counterclockwise direction to the full line position shown therein (the dotted line position as shown in FIG. 7). As further shown in FIG. 7, the shoulder element 42 is biased in a clockwise direction by a suitable spring 45. The support 24 is provided with a front flange 46 which engages the shoulder element 42 when the shoulder element is pivoted in a clockwise direction to the stop position shown in full lines in FIG. 7. Such positioning of the shoulder element is effected immediately when the door 13 is moved away from the closed position of FIG. 5 (broken line position of FIG. 7).

Thus, when the door 13 is in the closed position, shoulder element 42 is positioned to permit the free movement of the receptacle 18 past the element 42 to the ice access position of FIG. 3. When the door 13 is open, the shoulder element 42 is positioned to be engaged by the receptacle portion 46 at a position of the receptacle only slightly forward of the storage position of FIG. 2, so that the crossbar 27 remains spaced rearwardly from the sensing element 20 and normal operation of the ice maker may continue. The intermediate position of the ice receptacle is shown in dotted lines in FIG. 5.

Figure 9:
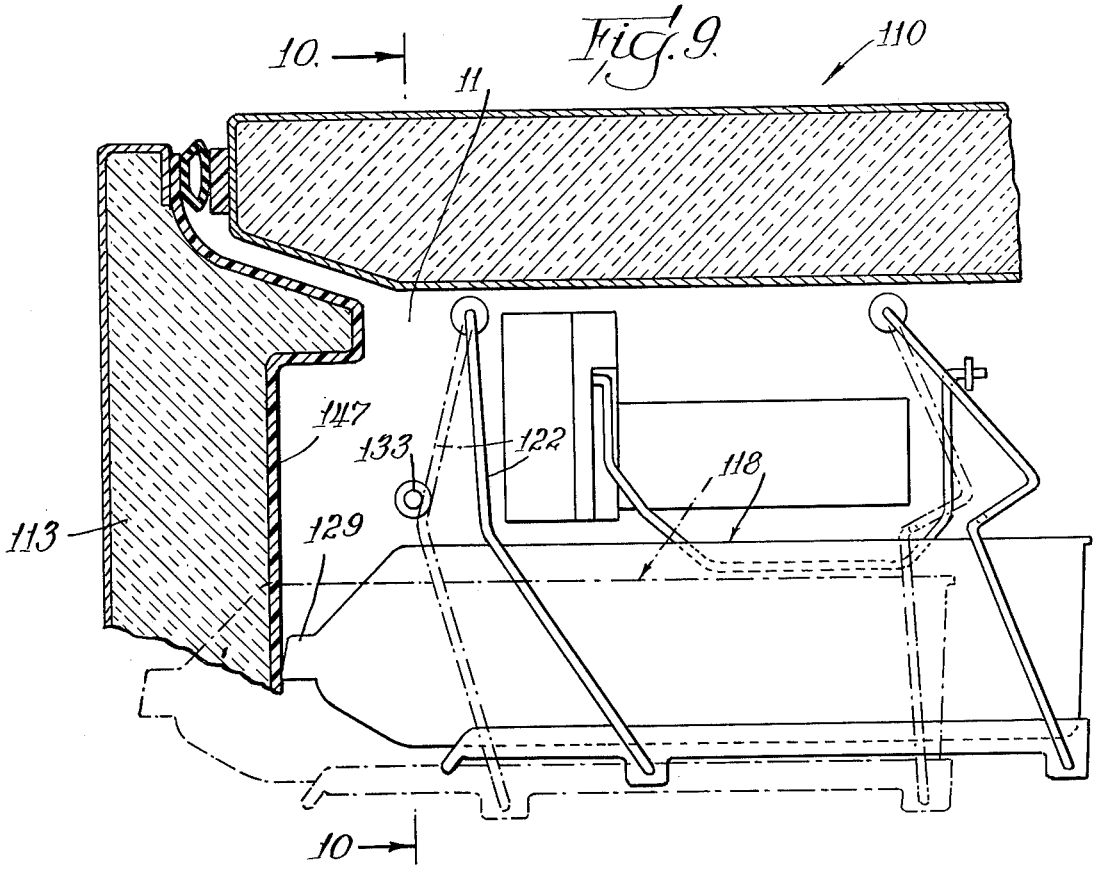
FIG. 9 is a fragmentary vertical section illustrating a modified form of apparatus embodying the invention wherein the small access opening closure is eliminated and the receptacle automatically disposed selectively in the storage and access positions as an incident of movement of the main freezer door between closed and open positions.
Figure 10:
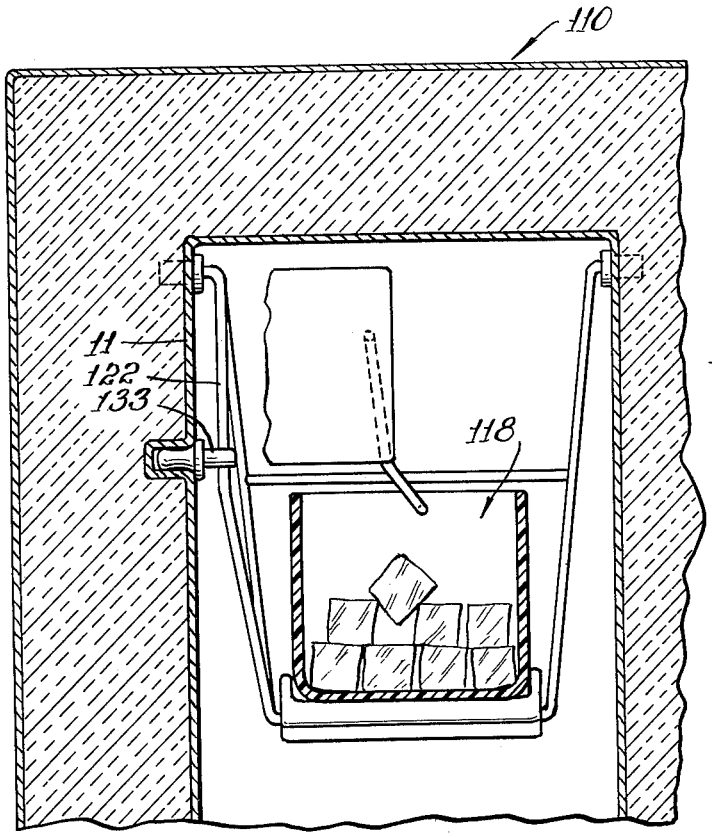
FIG. 10 is a fragmentary vertical section taken substantially along the line 10—10 of FIG. 9.

The invention further comprehends other forms of means for bringing the ice receptacle to the ice access position as a function of the door movement. Illustratively, as shown in FIGS. 9 and 10, a modified form of apparatus generally designated 110 is shown to comprise a refrigeration apparatus wherein the ice receptacle 118 includes a handle portion 129 resting against the inner wall 147 of the freezer door 113 when the freezer door is in the closed position. As freezer door 113 does not include a separate ice access door, access-providing movement of the ice receptacle is effected as an incident of the movement of freezer door 113. A stop 133 is mounted to the cabinet wall 11 in the path of swinging movement of one of the front links 122 for stopping the forward movement of the assembly at the ice access position illustrated in dotted lines in FIG. 9.

As shown in FIG. 9, the movement of the ice receptacle 118 is similar to the movement of the receptacle 18 in apparatus 10 in moving from the storage position to the ice access position.

In each of the embodiments, the movement of the ice receptacle from the storage position commences gradually and in a somewhat downward direction. When the ice receptacle reaches the ice access position, a sudden deceleration is effected tending to shift the ice bodies in the receptacle to the forward ice access position until the access door is closed. The closing of the ice access door effects a repositioning automatically of the ice receptacle to back to the storage position. The movement of the ice receptacle may be caused to be sufficient to move downwardly below the level sensing means of an associated automatic ice maker so as to avoid interference therebetween in the selective positioning of the ice receptacle.

The movement of the ice receptacle is effected by gravity upon release of the receptacle from the storage position as an incident of the opening of the ice access door. The necessary potential energy restoration is effected automatically by the closing of the ice access door.

As will be obvious to those skilled in the art, control of the movement of the ice receptacle may be effected manually by the provision of suitable latches on the cabinet walls in lieu of the control elements of the disclosed embodiments.

The improved refrigeration apparatuses of the disclosed embodiments are extremely simple and economical of construction. The elimination of connections between the ice receptacle and closure means simplifies the construction and alignment of the ice access assembly, provides a lower cost of assembly, and minimizes maintenance requirements. In addition, the desired movement of the ice receptacle is obtained regardless of whether the ice access door is pivoted about a horizontal axis or a vertical axis.

The disclosed arrangements further assure that the collected ice bodies tend to remain in the forward portion of the receptacle after being urged thereto by the above described movement of the receptacle from the storage position to the ice access position. The movement of the ice receptacle back to the storage position is reversely similar of the movement from the storage position to the ice access position and, thus, the collected ice bodies tend to remain in the forward portion of the receptacle permitting more uniform distribution of the collected ice bodies in the receptacle upon delivery of further ice bodies from the ice maker thereto.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having a cabinet defining a refrigeration space provided with an opening, and a receptacle for storing ice within said space, improved means for providing access to said ice comprising:

mounting means for removably carrying said receptacle for swinging movement about a horizontal pivot axis between a rearward upper ice storage position within said space and a forward lower ice access position adjacent said opening;

a closure movable between a first position wherein said closure closes said opening with said receptacle being retained in said rearward position, and a second position wherein said opening is exposed, said receptacle being repositioned fowardly from said storage position to said access position as an incident of movement of said closure from said first to said second position to permit access to ice in said receptacle; and stop means for effecting rapid deceleration of the forward movement of said receptacle at said access position when the closure is moved to said second position thereby to urge ice in said receptacle forwardly therein.

2. The refrigeration apparatus means of claim 1 wherein said decelerating means comprises stop means for abruptly positively terminating forward movement of said receptacle at said access position.

3. The refrigeration apparatus means of claim 1 wherein said mounting means is arranged to cause the receptacle to accelerate to maximum forward velocity at said access position in moving from said storage position to said access position.

4. The refrigeration apparatus means of claim 1 wherein said decelerating means comprises a stop means carried by said cabinet.

5. In a refrigeration apparatus having a cabinet defining a refrigeration space provided with an opening, and a receptacle for storing ice within said space, improved means for providing access to said ice comprising:

mounting means for mounting said receptacle for swinging movement about a horizontal pivot axis between a rearward upper ice storage position within said space and a forward lower ice access position adjacent said opening;

a closure movable between a first position wherein said closure closes said opening with said receptacle being retained in said rearward position, and a second position wherein said opening is exposed, said receptacle being repositioned forwardly from said storage position to said access position as an incident of movement of said closure from said first to said second position to permit access to ice in said receptacle; and means for effecting rapid deceleration of the forward movement of said receptacle at said access position, said decelerating means terminating movement of said receptacle toward said access position at a point ahead of the lowermost point to which said receptacle would otherwise move, thereby gravity biasing said receptacle toward said access position.

6. In a refrigeration apparatus having a cabinet defining a refrigeration space provided with an opening, and a receptacle for storing ice within said space, improved means for providing access to said ice comprising:

mounting means for removably carrying said receptacle in free resting movable association therewith for movement therewith between a rearward ice storage position within said space and a forward ice access position at said opening, said receptacle and mounting means being gravity biased toward said forward ice access position; and a closure movable between a first position wherein said closure closes said opening with said receptacle being retained in said rearward position by engagement of a portion of the closure with a portion of the receptacle carried on the mounting means, and a second position wherein said opening is exposed, said receptacle being repositioned forward from said storage position to said access position as an incident of movement of said closure from said first to said second position to permit access to ice in said receptacle.

7. The refrigeration apparatus of claim 6 wherein said mounting means comprises means for swingably carrying said receptacle with said ice storage position being disposed at a level above the level of said ice access position.

8. The refrigeration apparatus of claim 6 wherein means for sensing the level of ice in said receptacle project downwardly into the receptacle when the receptacle is in said ice storage position and said mounting means cause said receptacle to move below and away from said sensing means in moving from said ice storage position to said ice access position.

9. The refrigeration apparatus of claim 6 wherein said mounting means is arranged to cause the path of movement of said receptacle between said storage and access positions to be arcuate.

10. The refrigeration apparatus of claim 6 wherein said mounting means is arranged to cause the path of movement of said receptacle between said storage and access positions to be arcuate with the path being substantially horizontal when the receptacle is disposed at said access position.

11. The refrigeration apparatus of claim 6 wherein said closure is arranged to cause said receptacle to move from said access position rearwardly to said storage position against said bias as an incident of said closure being moved to said first position.

12. The refrigeration apparatus of claim 6 wherein said mounting means comprises a plurality of pivotally mounted arms swingably supporting said receptacle.

13. The refrigeration apparatus of claim 6 wherein said mounting means is arranged to support said receptacle in said access position to have a forward portion of the receptacle disposed in said opening.

14. In a refrigeration apparatus having a cabinet defining a refrigeration space provided with an opening, and a receptacle for storing ice within said space, improved means for providing access to said ice comprising:

mounting means for mounting said receptacle for movement between a rearward ice storage position within said space and a forward ice access position at said opening;

a closure movable between a first position wherein said closure closes said opening with said receptacle being retained in said rearward position, and a second position wherein said opening is exposed to permit access to ice in said receptacle, said receptacle being repositioned forwardly from said storage position to said access position as an incident of movement of said closure from said first to said second position; and selective positioning means for gradually accelerating the receptacle forwardly from said storage position to said access position as an incident of said closure being moved from said first position to said second position, and abruptly stopping said receptacle at said access position.

15. The refrigeration apparatus of claim 14 wherein said positioning means comprises separably abutting surfaces on said closure and receptacle respectively.

16. The refrigeration apparatus of claim 14 wherein said positioning means is arranged to stop the accelerating forward movement of the receptacle selectively at a third, forward position intermediate said first and second positions.

17. The refrigeration apparatus of claim 14 wherein said positioning means includes link means swingably carrying said receptacle.

18. The refrigeration apparatus of claim 6 wherein the mounting means includes a plurality of pivotal links suspending a support carrying the receptacle for swinging motion within said refrigeration space.

19. The refrigeration apparatus of claim 18 wherein said ice receptacle has a front portion which extends forwardly beyond said support and contacts the inner surface of said ice access door.

20. In a refrigeration apparatus having a cabinet defining a refrigeration space and means for storing ice within said space, an improved apparatus for providing access to said stored ice, comprising:

an ice access door closing at least a portion of said refrigeration space;

a movable, generally horizontal support located within said refrigeration space behind said access door;

a plurality of pivotal links suspending said support for swinging motion within said refrigeration space; and an ice receptacle removably carried by said support, said support being arranged such that said receptacle swings by gravity to an ice access position upon opening movement of said access door, said support comprising a tray having an open front portion and said receptacle comprising an ice bin slidably received by said tray, said receptacle further having a front portion which extends beyond said forward portion of said tray.

21. In a refrigeration apparatus having a cabinet defining a refrigeration space and means for storing ice within said space, an improved apparatus for providing access to said stored ice, comprising:

an ice access door closing at least a portion of said refrigeration space;

a movable, generally horizontal support located within said refrigeration space behind said access door;

a plurality of pivotal links suspending said support for swinging motion within said refrigeration space;

an ice receptacle removably carried by said support, said support being arranged such that said receptacle swings by gravity to an ice access position upon opening movement of said access door; and stop means disposed within said refrigeration space so as to engage said movable support, thereby abruptly terminating outward movement of said receptacle at said access position.

* * * * *